US007510679B2

(12) United States Patent
Motomura et al.

(10) Patent No.: US 7,510,679 B2
(45) Date of Patent: Mar. 31, 2009

(54) TAPHOLE COOLING STRUCTURE

(75) Inventors: Tatsuya Motomura, Oita (JP); Takayuki Arakane, Oita (JP); Masaharu Takahashi, Oita (JP); Kazunori Moribe, Oita (JP); Yoshiaki Suzuki, Oita (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 11/754,988

(22) Filed: May 29, 2007

(65) Prior Publication Data

US 2008/0128964 A1 Jun. 5, 2008

(30) Foreign Application Priority Data

Nov. 30, 2006 (JP) ..... 2006-323702

(51) Int. Cl.
*C21C 5/00* (2006.01)

(52) U.S. Cl. ..... 266/241; 266/236

(58) Field of Classification Search ..... 222/592; 266/236, 241

See application file for complete search history.

(56) References Cited

U.S. PATENT DOCUMENTS 5,409,197 A * 4/1995 Davis ..... 266/46
5,437,768 A * 8/1995 Smith et al. ..... 222/592
5,667,201 A * 9/1997 Beveridge et al. ..... 222/592
5,800,773 A * 9/1998 Beveridge et al. ..... 266/236

FOREIGN PATENT DOCUMENTS

JP 2006-071212 3/2006

* cited by examiner

*Primary Examiner*—Scott Kastler
(74) *Attorney, Agent, or Firm*—Leighton K. Chong

(57) ABSTRACT

The present invention provides a taphole cooling structure allowing prevention of wear and deformation of peripheral bricks of the taphole and maintaining stable operation of the furnace in high copper matte grade operations and high load operations. The taphole cooling structure is provided with a hollow jacket body to be inserted into an opening penetrated on a furnace wall, wherein a water passage is installed in the internal of the jacket body for circulating cooling water while a flange made of the same material as the furnace wall is provided on the periphery of said jacket body to be weldingly connected to the said furnace wall, wherein a refractory material is filled within a hollow of the said hollow jacket body and perforated with a taphole for draining solutions from the furnace body.

3 Claims, 5 Drawing Sheets

TAPHOLE COOLING STRUCTURE

FIELD OF THE INVENTION

The present invention relates to a structure for cooling a taphole, and more particularly to a taphole cooling structure for effectively cooling the taphole for draining solutions such as matte and slag from a flash furnace and slag cleaning furnace employed in copper smelting as well as the periphery thereof.

BACKGROUND OF THE INVENTION

First of all, an outline of the processes in copper smelting will be explained. Ore dug out from a mine is called "crude ore", and since it contains large amount of worthless materials (so called gangues) besides useful minerals, gangues are removed from the crude ore as tailings by a process called "concentration", and the concentrates of high-grade obtained thereby are applied to smelting. The difference in physical or physicochemical property of minerals such as density, hardness, magnetism, permittivity, wettability is employed in the concentration processes.

Concentrates obtained by concentration are thermally dried for the purpose of reducing heat energy required in smelting processes, making easier to handle minerals in case of supplying and transporting them to furnaces, and also avoiding decrease in responsiveness due to moisture. Drying process is implemented, for example, by a rotary drier such as rotary kiln comprising a furnace formed in a slightly sloping long cylindrical shape.

Concentrates obtained are supplied to a flash furnace with the oxygen enriched air or hot air of high temperature simultaneously to induce chemical reaction, and separated to matte and slag by the difference in specific gravity. The flash furnace 1 employed in the process is comprised of a reaction shaft 3, a settler 5 and an uptake 7 as shown in FIG. 7, and the said reaction shaft 3 is provided with 1~3 concentrate burners 9, 9. The concentrates are blown into the furnace via the concentrate burners 9, 9. The flash furnace is characterized to be lower in specific fuel consumption than other means since it utilizes heat produced by oxidation reaction of the concentrates. However, in case the heat produced by oxidation reaction is not enough, auxiliary combustions from the concentrate burners 9, 9 using fuel oil and such can be implemented.

Matte in a molten state is then drained from matte tapholes 2*a*, 2*a* plurally installed near the bottom of the flash furnace 1. 60% to 70% of copper is normally included in the matte obtained in this process. On the other hand, about 1% of copper is included in the slag, so it is drained from a slag taphole 2*b* perforated at the lower part of the uptake 7 to be sent to a slag cleaning furnace 1*a* and cleaned. Then the copper obtained is recovered in a form of matte and combined to the matte obtained from the flash furnace 1 to be processed in a converter. A more high-grade electrolytic copper will then be manufactured by electrolytic refining.

Today, in copper smelting industry employing flash furnaces, a melting operation is becoming high-load, with the annual processing quantity per furnace which used to be 300,000 tons, now increasing to its doubled quantity. Since the amount of oxygen enriched air as well as the temperature within the furnace become more severe in high-load operations, refractory materials such as heatproof bricks within the furnace will wear out more quickly. Particularly, heat load to the lower part of the shaft and the connection between the shaft and the settler will be increased significantly. Due to such reasons, there was a need to replace the refractory material within the furnace more frequently, and in the aim of stopping the progression of refractory deterioration, a structure for cooling the furnace body has been proposed (for example in JP Patent Publication No. 2006-71212).

[Patent Reference 1] JP Patent Publication No. 2006-71212 Official Gazette

SUMMARY OF THE INVENTION

In a high-load operation of copper smelting employing a flash furnace which processes twice as much as the conventional operation, the amount of matte and slag drained from tapholes of the furnace body will naturally be twice the amount of the conventional operation. However, tapholes in the conventional flash furnace is formed on the refractory bricks (taphole bricks) filled within a frame made of steel shell, and the frame was normally not cooled. It was likewise in the tapholes of a slag cleaning furnace.

Due to above circumstances, as the operation becomes high copper matte grade operation and high-load, the load on the taphole bricks and refractory materials at its periphery gradually becomes higher, and leads to a quick deformation of the frame as well as wear and deformation of the taphole. At worst, there is a risk of solutions leaking out from between the deformed bricks in case of the conventional structure.

Therefore, it is an object of the present invention to provide a structure for cooling a taphole to effectively cool the taphole bricks and its periphery in order to prevent the wear and deformation of the bricks surrounding the taphole for taking out solutions in the furnace body, and to maintain a stable operation of a flash furnace and a slag cleaning furnace.

In order to achieve the above mentioned object, an invention provides a taphole cooling structure for cooling a taphole for draining solutions such as matte and slag from a furnace body provided with a hollow jacket body to be inserted into an opening penetrated on a furnace wall, wherein a water passage is installed in the internal of the said jacket body for circulating cooling water while a flange made of the same material as the above furnace wall is provided on the periphery of the said jacket body to be weldingly connected to the said furnace wall, wherein a refractory material is filled within a hollow of the said hollow jacket body, and perforated with a taphole for draining the solutions from the furnace body.

In order to achieve the above mentioned object, a structure for cooling a taphole is provided wherein the said jacket body is comprised by joining an inner frame made of steel provided with the said flange and disposed to be positioned within the furnace and an outer frame made of copper disposed to be positioned outside of the furnace.

In order to achieve the above mentioned object, a structure for cooling a taphole is provided wherein the said water passage is installed within the said outer frame made of copper so as to surround the hollow formed on the said outer frame.

In order to achieve the above mentioned object, a structure for cooling a taphole is provided wherein the said furnace is a flash furnace or a slag cleaning furnace.

According to the taphole cooling structure of the present invention provided with a water passage for circulating cooling water within the hollow jacket body, it is possible to restrain the load against the taphole bricks and refractory materials located at its periphery as well as to effectively prevent the wear and deformation of the taphole bricks. As a result, a stable operation of the flash furnace becomes possible and the risk of solution leakage can be prevented.

Moreover, according to the taphole cooling structure of the present invention designed in a jacket structure, it is possible to easily install an effective cooling structure subsequently to a furnace body having no cooling structure installed around the tapholes without conducting a major renovation work.

Furthermore, according to the taphole cooling structure of the present invention with a jacket body formed of steel and copper integrally jointed together, it enables an easily welding of the steel flange to the existing steel shell section of the furnace body on site while copper section having high thermal conductivity effectively cools the taphole.

PREFERRED EMBODIMENTS OF THE INVENTION

A preferred embodiment of a taphole cooling structure according to the present invention will be explained in detail below. FIG. 1 is a perspective view of the preferred embodiment of a jacket body of a taphole cooling structure according to the present invention, FIG. 2 is a front view thereof, FIG. 3 is a bottom view thereof and FIG. 4 is a side view thereof.

As can be seen from FIG. 1~4, a jacket body 10 is generally formed in a shape of quadrangular prism with a hollow, and a brim-like flange 13 formed protruding outward on the external surface thereof. As can be seen from FIG. 6, the flange 13 is formed at an angle according to the inclination angle of an opening 5*b* perforated on a furnace wall 5*a*. A refractory material 30 such as fire-proof brick is to be filled within the hollow 10*a* of the jacket body 10, and a taphole 2*a* for draining solutions such as matte and slag is produced approximately at the center of the refractory material 30 filled within the hollow 10*a*. Magnesia-chrome brick, zircon brick can be used, for example, as a refractory material 30 to be filled in the hollow 10*a*.

As can be seen from FIG. 4, the jacket body 10 is formed by integrally joining an inner frame 11 (shaded part) made of steel provided with the flange 13 disposed to be positioned inside the furnace body and an outer frame 15 made of copper disposed to be positioned outside the furnace body. More specifically, the jacket body 10 is integrally formed by welding together the inner frame 11 and the outer frame 15 respectively formed in a quadrangular prism with a hollow. On the outer frame 15, a thick-walled outer rim 17 provided with grooves 17*a* is formed integrally, which further contributes in enhancing the cooling effect.

Since the thermal conductivity of copper is 354 W/m·K at 700° C. which is 10 times greater than the thermal conductivity of steel of 34 W/m·k, the welded section tends to be ill-conformed due to rapid diffusion of heat at the time of welding, and may induce defective joining. Therefore, it is necessary to adequately heat the copper material and to employ a special welding rod made mainly of copper when welding the inner frame 11 and the outer frame 15. In such respect, it can also be considered to make the jacket body 10 entirely out of copper. However, the jacket body 10 of copper needs to be directly welded onto the steel shell of the furnace body on site where the furnace is installed. Welding the jacket body 10 on site where the furnace is installed involves difficulty with heavy workload considering the conditions that the copper material needs to be adequately heated when welding the steel component and copper component together, and that the 2 elements needs to be welded by flat position welding to ensure the quality. Reflecting on such points, by using steel, which is the same material used in furnace wall 5*a* to form the part (inner frame 11 part) provided with the flange 13 welded to the steel shell of the furnace body, the process of welding the jacket body 10 on site is made easier and also facilitates the installation of the jacket body 10 to the furnace body. From such composition, it becomes possible to install the jacket body 10 to the steel shell of the furnace body with more ease and less time, as well as to greatly reduce the workload in installation and maintenance such as replacement of jackets.

A water passage 23 for circulating cooling water is internally formed in the outer frame 15 made of copper so as to surround the hollow 10*a*, as shown in FIG. 2. The water passage 23 is communicated with an inlet duct 20 and an outlet duct 21 formed at the lower part of the lateral side in order to convey the cooling water supplied from the inlet duct 20 via the water passage 23 to circulate around the circumference of the outer frame 15 and finally drained from the outlet duct 21 (refer to FIG. 5). By composing the structure as such to cool the components via the outer frame 15 made of copper with high heat conductivity, it is possible to efficiently cool the refractory material 30 disposed within the hollow 10*a* as well as the furnace wall 5*a* at its periphery. Combination of materials of which the jacket body 10 is made is not limited to above. However, combination of steel and copper is preferable in respect of cooling efficiency and required cost and such.

Next, a method of installation of the jacket body 10 to the opening 5*b* of the furnace wall 5*a* as well as establishment of the taphole 2*a* is explained.

Firstly, the jacket body 10 is inserted into the opening 5*b* of the furnace wall 5*a* from the inner frame 11 part, and the flange 13 is attached closely to the opening 5*b* of the furnace wall 5*a*. Periphery 13*a* of the flange 13 is welded to the opening 5*b* of the furnace wall 5*a* in order to fix the jacket body 10 to the steel shell of the furnace body. Such welding process is easy to perform and ensures a sufficient strength since the welding is performed to the components made of similar material. Then the refractory material 30 is filled within the hollow 10*a* of the jacket body 10, and the taphole 2*a* is perforated approximately at the center thereof.

Next, hoses are connected to the inlet duct 20 and outlet duct 21 respectively to be communicated to, for example, a cooling water tank which is not shown in the drawings. The above process is repeatedly performed to each of the openings 5*b* provided on the furnace. In case of the flash furnace depicted in FIG. 7, 5 tapholes 2*a* (matte tapholes) are provided on one side and a single taphole 2*b* (slag taphole) is provided at the lower part of the uptake 7, and the above process is performed to the respective tapholes. The same process is also performed to a taphole 2*b* (slag taphole) provided on the slag cleaning furnace.

EXAMPLE

A jacket body 10 comprised of an inner frame 11 and an outer frame 15 of about 10 mm in thickness made of steel and copper respectively, formed with a hollow 10*a* of about 400×400 mm in size with a taphole 2*a* of about 120 mm in diameter perforated on magnesia-chrome bricks filled within the said hollow 10*a*, and further provided with a water passage 23 with an inner diameter of about 30 mm is installed to an opening 5*b* of a furnace and operated.

In a conventional structure, the taphole bricks needed to be replaced every 5 months of operation in approximate, however, according to the present embodiment, no wear or deformation was evident even though the taphole bricks were not replaced for about a year.

Therefore there would be no risk of solution leakage, and the safety of the operation is enhanced. Moreover since the frequency of conducting maintenance operation such as replacing taphole bricks is reduced, the cost required for replacement would also be reduced. The time saved thereby can be utilized for smelting operation, which lengthens the operation duration and further contributes to the high-load operation.

Figure 1:
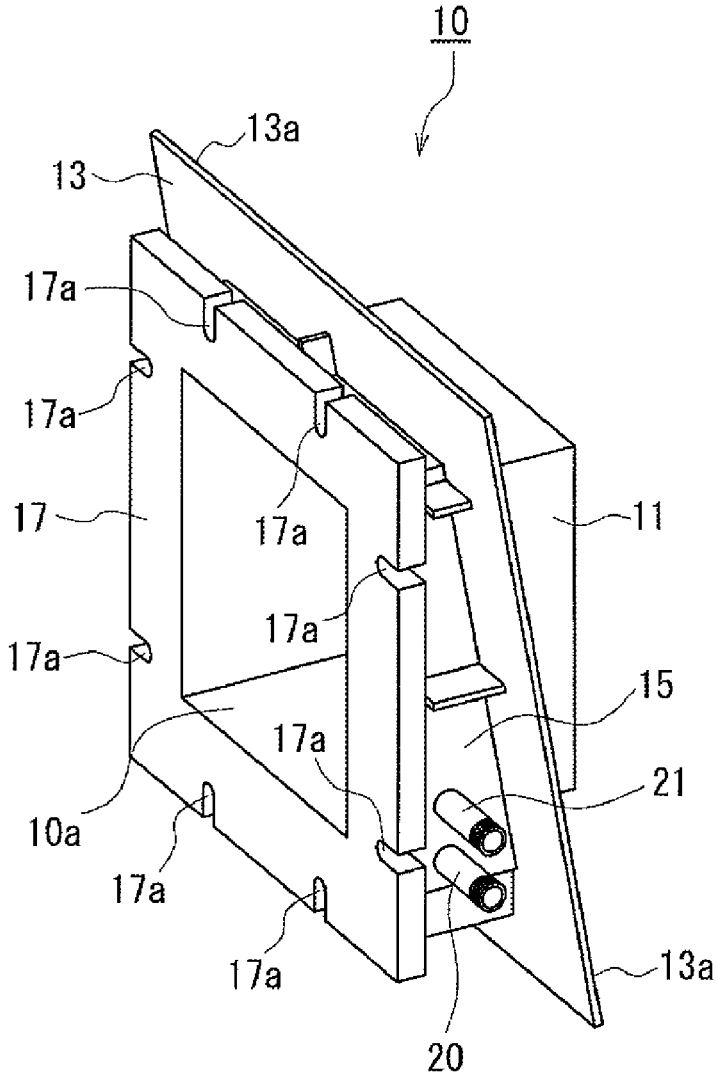
FIG. 1 is a perspective view of a preferable embodiment of a jacket body of a taphole cooling structure according to the present invention.
Figure 2:
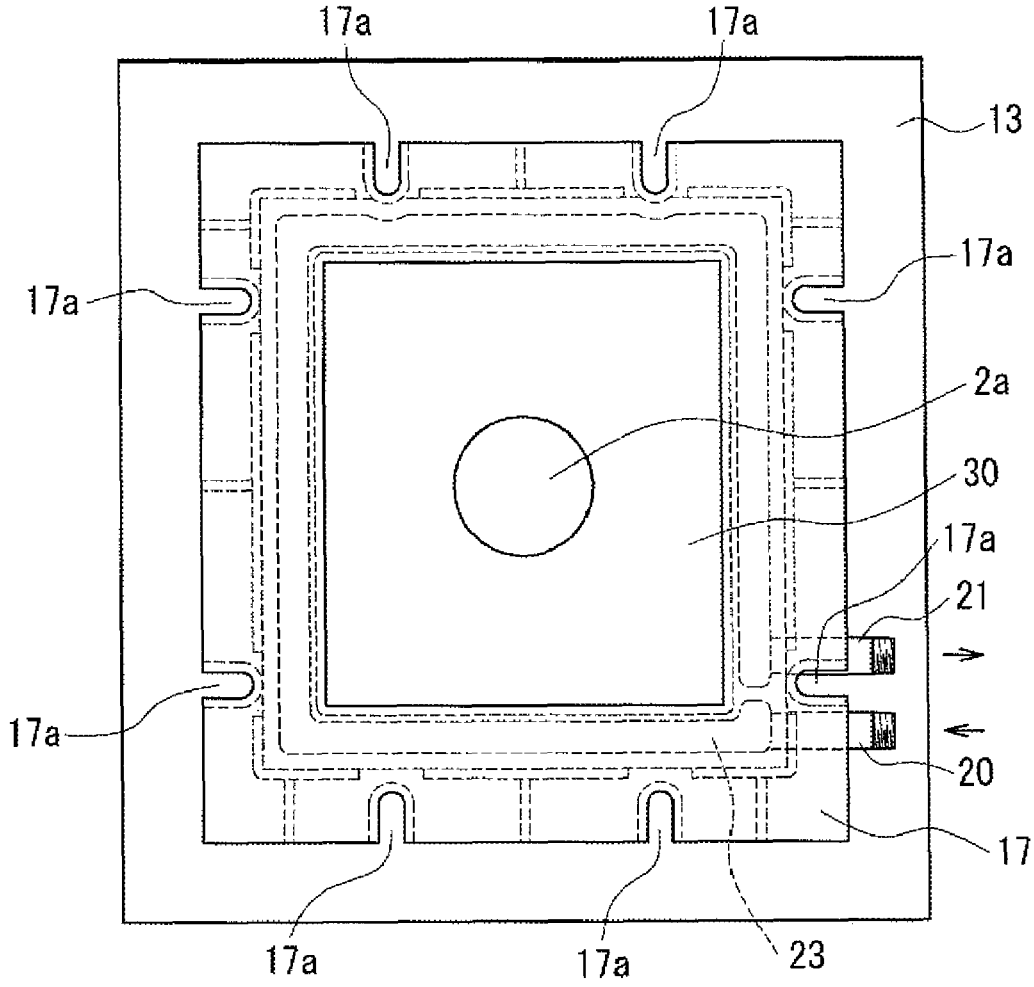
FIG. 2 is a front view of the jacket body of FIG. 1.
Figure 3:
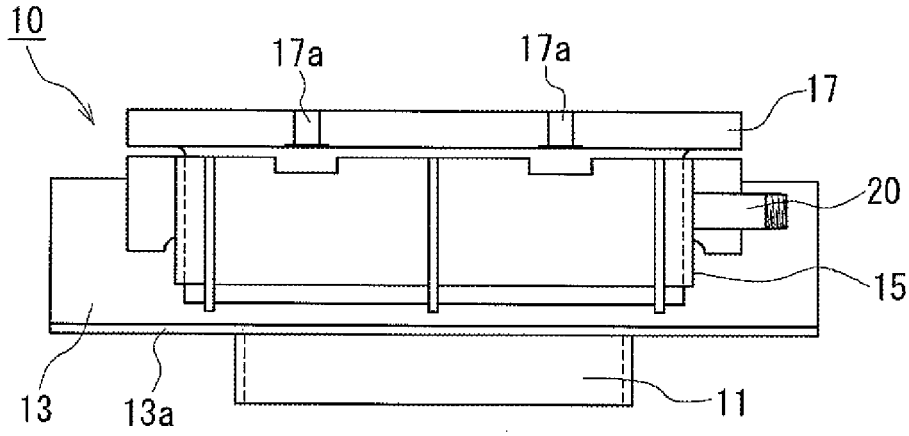
FIG. 3 is a bottom view of the jacket body of FIG. 1.
Figure 4:
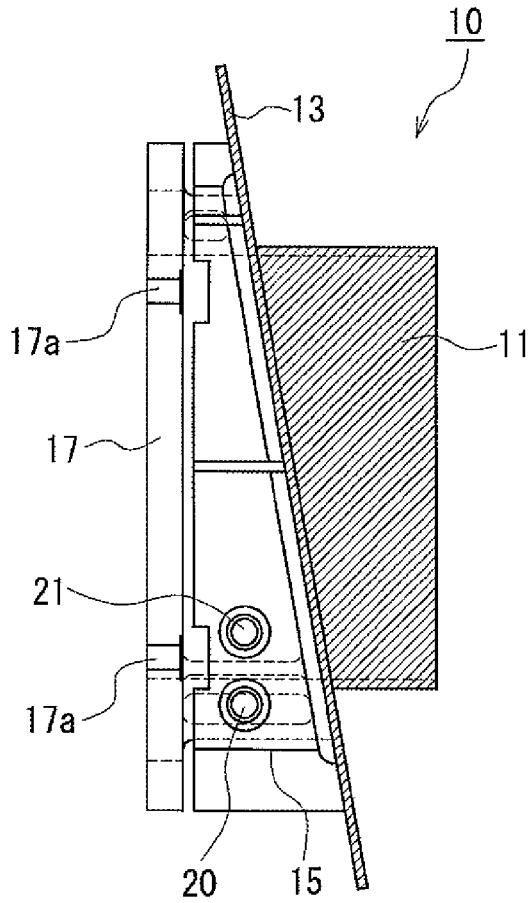
FIG. 4 is a side view of the jacket body of FIG. 1.
Figure 5:
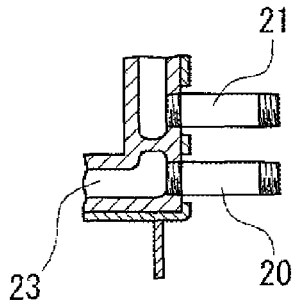
FIG. 5 is a partially cross sectional view showing an inlet duct and an outlet duct.
Figure 6:
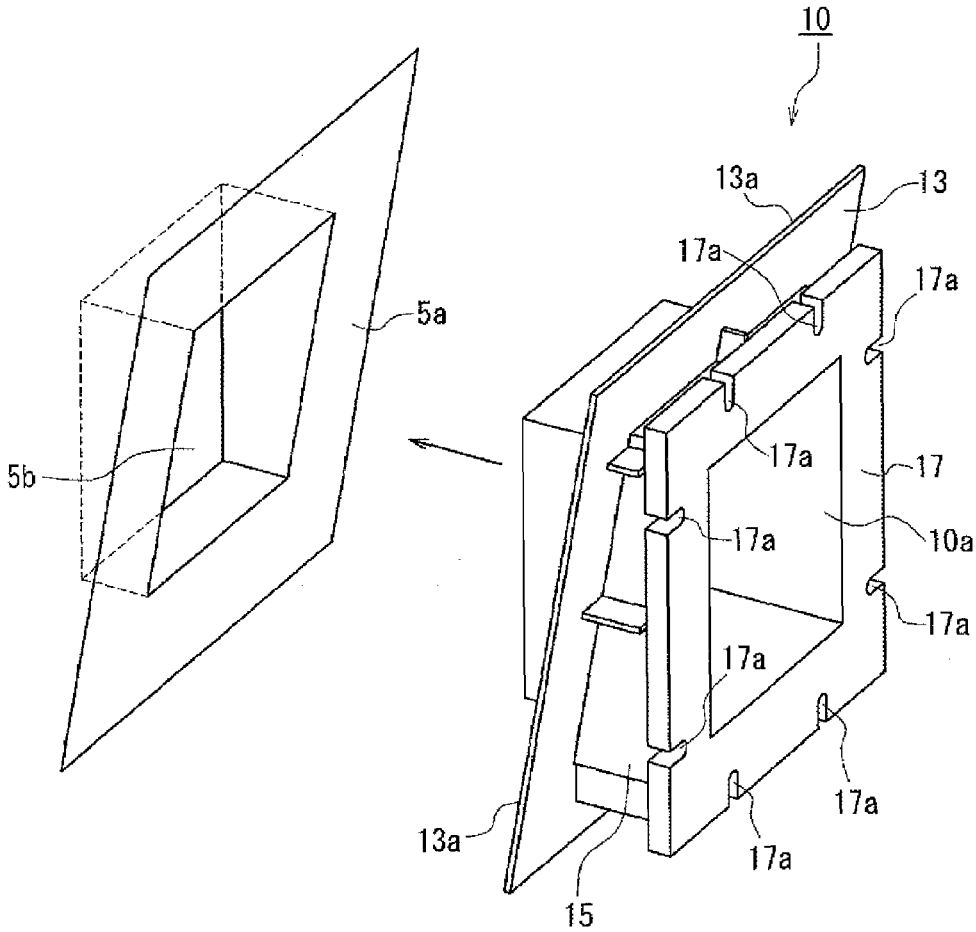
FIG. 6 is a perspective view showing an installation of the jacket body to an opening of the furnace.
Figure 7:
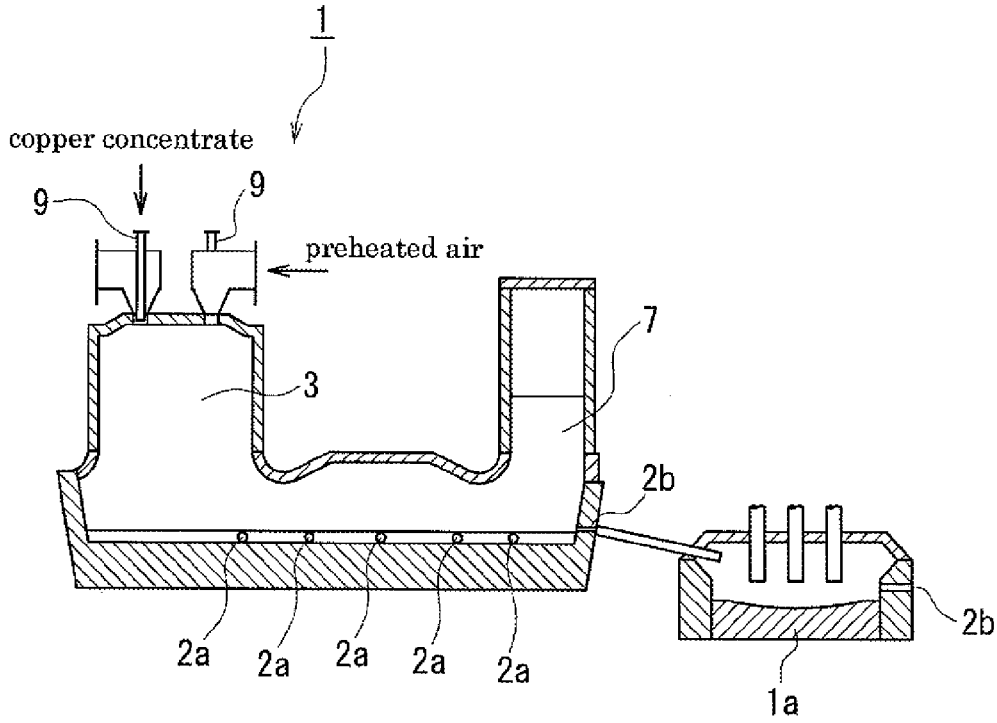
FIG. 7 is a schematic view of a flash furnace and a slag cleaning furnace.

What is claimed is:

1. A structure for cooling a taphole for draining molten metal such as matte and slag from a furnace body of a flash furnace for copper smelting, comprising:

a hollow jacket body having a forward portion formed with a brim-like flange and inner frame made of the same material as the furnace body for readily welding to an exit part of the furnace body, and also having a rearward part composed of an outer frame made of copper that surrounds a hollow portion which is filled with refractory material and has a taphole cutout therein, wherein said outer frame is surrounded by cooling pipes made of copper and provides passage for flow of cooling fluid therein, said inner frame of furnace material of the forward part and said outer frame of the rearward part of said hollow jacket body being integrally joined together for readily attaching it as an integral unit by welding the forward part to the furnace body, while the rearward part has a high cooling effect of removing heat from the refractory material lining the taphole.

2. A structure for cooling a taphole in accordance with claim 1, wherein the said jacket body is comprised by joining an inner frame made of steel provided with the said flange disposed to be positioned within the furnace.

3. A structure for cooling a taphole in accordance with claim 2, wherein the said water passage is installed within the said outer frame made of copper so as to surround the hollow formed on the said outer frame.

* * * * *